United States Patent [19]

Farler

[11] Patent Number: 4,958,838

[45] Date of Patent: Sep. 25, 1990

[54] SNAP-ON DART FLIGHT

[76] Inventor: Charles W. Farler, 4503 Woodbine Ave., Dayton, Ohio 45420

[21] Appl. No.: 918,720

[22] Filed: Oct. 14, 1986

Related U.S. Application Data

[63] Continuation-in-part of Ser. No. 868,804, May 27, 1986, abandoned.

[51] Int. Cl.[5] ..... A63B 65/02

[52] U.S. Cl. ..... 273/423; 403/165

[58] Field of Search ..... 273/423, 416, 419, 420; 403/165

[56] References Cited

U.S. PATENT DOCUMENTS

| | | | |
|---|---|---|---|
| 434,262 | 8/1890 | Freeman | 403/165 X |
| 4,114,884 | 9/1978 | Tunnicliffe | 273/423 |

FOREIGN PATENT DOCUMENTS

| | | | |
|---|---|---|---|
| 445590 | 4/1936 | United Kingdom | 273/423 |
| 498823 | 1/1939 | United Kingdom | 273/423 |
| 1370092 | 10/1974 | United Kingdom | 403/165 |
| 1508075 | 4/1978 | United Kingdom | 273/423 |
| 2052277 | 1/1981 | United Kingdom | 273/423 |
| 2064967 | 6/1981 | United Kingdom | 273/423 |

*Primary Examiner*—Paul E. Shapiro
*Attorney, Agent, or Firm*—Joseph Patrick Burke

[57] ABSTRACT

A snap-on dart flight that is readily attachable to a flight rotation shaft by the simple procedure of inserting the shaft mating portion into an internal axial cavity located within the flight. The axial flight cavity is comprised of a flight mating portion having one or more extension(s) and/or recess(es) which can be of any desired cross-sectional shape. e.g., rounded, v-shaped, cylindrical, etc., and is located along the flight central axis. The flight of this invention is comprised of a centrally located bushing tube having a plurality of vanes, usually four, equally spaced around said bushing tube. The vanes can be integral with the flight bushing tube or mounted on the outside surface thereof, e.g., using an adhesive. In accordance with a preferred embodiment of this invention, the flight is molded or otherwise formed in one piece to have the axial cavity described. Alternatively, a flight axial bore tube can be inserted within the flight bushing tube to define said cavity forward portion. Although the flight is preferably free to rotate 360 degrees around its central axis, it can be fixed in position, at the election of the user.

7 Claims, 2 Drawing Sheets

SNAP-ON DART FLIGHT

This application is a continuation-in-part of U.S. patent application Ser. No. 868,804 filed May 27, 1986, entitled Snap-On Dart Flight, now abandoned by the present inventor.

The present invention is directed to a snap-on dart flight that is attachable to a flight shaft assembly which comprises the dart body rearward portion, and a flight rotation shaft assembly having a cylindrical shaft forward portion and a flight mating portion having an outer diameter having one or more portion(s) of larger (extension) and/or smaller (recess) diameter than its remaining portion(s) to enable the flight to mate at such portion(s) in a slip-fit with one or more respectively smaller and/or larger inner diameter cavity portion(s) of the dart flight by the simple procedure of inserting the shaft extension(s) and/or recess(es) into the corresponding recess(es) and/or extension(s) of the axial cavity of the flight. The central axial cavity (bore) of the flight can be comprised of one or more smaller diameter portion(s) [recess(es)] communicating with one or more larger diameter (extension) portion(s) and said recess(es) and extension(s) can be of any desired shape, e.g., rounded, v-shaped, cylindrical, etc. Although the flight is preferably free to rotate 360 degrees around its central axis, it can be fixed in position, at the election of the user. The expression "slip-fit" means that there is sufficient clearance between the outer diameter extension(s) or recess(es) of the axial cavity mating portion and the corresponding recess(es) or extension(s) on the mating portion of the flight rotation shaft to permit the flight to rotate on the shaft even though the flight and shaft are joined.

The dart flight of this invention is characterized in that it eliminates the requirement common to prior art flights of having flight attachment means external to the outer surfaces of said flight. The flight of this invention is further characterized as having one or more extension(s) and/or recess(es) along its axial cavity mating portion. The rotatable flight of this invention has a plurality of vanes integral with its flight bushing tube. Usually the present flight has four such vanes equally spaced around its flight bushing tube. Alternatively said vanes can be adhesively secured to the outer surface of said flight bushing tube. These flight structures eliminate the difficulties encountered in aligning multiple flight fins with transverse slots, such as occur with prior art darts. The present dart flights likewise eliminate the probability present with prior art darts that the flight attachment means of a dart present in the target area of a dart board will either stop or deflect subsequently thrown darts striking same so as to cause a bounce-out or fall-out, both of which result in zero points. The flight of this invention is further characterized in that even when the flight surfaces are not properly aligned, the imperfection merely causes the flight of an airborne dart to rotate rather than adversely affecting the trajectory or attitude of said dart.

BACKGROUND OF THE INVENTION AND PRIOR ART

One of the problems causing bounce-out or fall out occurs when a subsequently thrown dart strikes the flight and/or flight attachment means of a dart which is already stuck in the dart board, thereby stopping or deflecting the trajectory of said subsequent (following) dart and reducing its momentum which increases the probability that it will fail to hit the intended target or fail to stick in the dart board. If a bounce-out or fall-out occurs then no score is produced. In addition, the following dart, by striking the flight of a prior thrown dart, may unseat the prior thrown dart causing the loss of whatever score it had produced. To further complicate the problem, such occurrences are more apt to happen when the subsequently thrown dart(s) target is in :lose proximity to the previously thrown dart(s) already positioned on the dart board. When the limited area in question is a high point scoring area, the results can be very detrimental to the dart thrower and his team.

Many proposals have been made in the prior art to obviate the problems caused by protruding flight attachment means and fixed flights when struck by following darts.

U.S. Pat. No. 4,109,915 issued to Walter Edward Bottelsen is directed to a breakaway dart, viz., one whose flight shaft and flight fall away from the dart body when the dart strikes the dart board.

U.S. Pat. No. 4,138,113 issued to Walter M. Sheldon, Jr. teaches the use of a cluster of four pins having elliptical rounded heads in a flight assembly with the leading end of the pins secured in a hole in the dart fletching body and maintained in close tangential juxtaposition by means of a heat shrinkable tube which encases the leading end of said pins from the front end of the dart.

U.S. Pat. No. 4,487,420 issued to Martin G. Ollis, et al, is directed to a dart having a shaft to carry the flight with a slot opening diametrically through the thickness of the shaft so that the flight can be deformed to a flat condition and pushed laterally through the slot. The extreme end of the shaft behind the flight is closed and pointed or rounded to provide a deflection surface in the event of contact by a further (following) dart.

British Pat. No. 534,289 issued to Farrington, et al, discloses a dart whose flight does not rotate when thrown, but can rotate when struck by a following dart. Thus the flight of a dart adhering to a dart board is revolvable about the pin f so that the flight has the capacity to turn and so to "give" if struck by other darts. The Farrington et al dart is stated by the patentees to be not apt to become torn.

British Pat. No. 589,208 issued to Frederick Alfred Richardson, et al, teaches use of a dart whose flight vanes 8 rotate relative to serrated shaft 2 via rotatable hub 6 mounted on pin 7.

British Pat. No. 1,488,373 issued to Mary Louise Frost, et al, is directed to a dart deflector for attachment to a dart. The deflector is comprised of an elongate body having a plurality of slots extending longitudinally from one end thereof, each slot being arranged such as in use it can accommodate a wing of a dart flight. The other end of the body has a tapered portion and the deflector is attachable to the dart solely by means of an engagement between the flight of the dart and portions of said elongate body forming the sides of said slots. When so engaged, the deflector is located axially to the flight of the dart so that in use when the dart has pierced a dart board, the point of a following dart approaching said dart in an axial or a substantially axial direction is deflected by the tapered portion of said dart deflector away from said dart. The dart flight comprises two separate flight portions each of which has a single fold along the longitudinal axis thereof. A complete dart flight is formed by locating two such dart flight portions in the longitudinally extending slots in the shaft of the dart.

British Pat. No. 1,508,075 issued to Robert Perkins, et al, discloses a rotatable coaxial stud shaft for dart carrier fins (flight) and rotates on being struck by a following dart.

Published British patent application No. GB 2007989 A by applicant and inventor, Albert Thomas Baker, is directed to end formation 15 for a dart flight 17 wherein said rear end formation forms an integral structure with a plurality of forwardly directed limbs 16. Rear end formation 15 is rearwardly tapered or pointed to deflect subsequently thrown darts.

Published British patent application No. GB 2064967 A of inventor Benjamin Charles Drake discloses a two part dart stem having a rear interfitting part 22 which carries the dart flight and is freely rotatable in relation to front part 20. Part 22 carries the flight and is a portion of the flight assembly which is secured to the metal barrel 12 via threaded bore 14.

BRIEF DESCRIPTION OF THE DRAWINGS

FIG. 10 illustrates a flight shaft with three flight shaft recesses (16) combined with a flight having one extension (13) in the flight cavity.

FIG. 11 illustrates a flight shaft having one recess located near the shaft rearmost mating portion in combination with a flight having one extension in its cavity.

In accordance with the present invention, it should be understood that one or more extension(s) can be provided on the flight rotation shaft with correspondingly shaped recesses of the same or different number on the flight cavity, or vice versa. Furthermore, combinations of a recess(es) and an extension(s) can be used on the flight rotation shaft mating portion with corresponding extension(s) and recess(es) on the flight cavity. Note FIGS. 1–6 in this regard. Moreover this(these) extension(s) can be of any desired shape, e.g., rounded, cylindrical, v-shaped, etc., and can be beveled, champfered, squared, etc. Also the forward portion of the shaft, viz., that portion not fitting within the flight cavity, can be of greater or lesser diameter than the shaft portion involved with mating, viz., the shaft portion within the flight cavity.

DETAILED DESCRIPTION OF THE INVENTION

Figure 1:
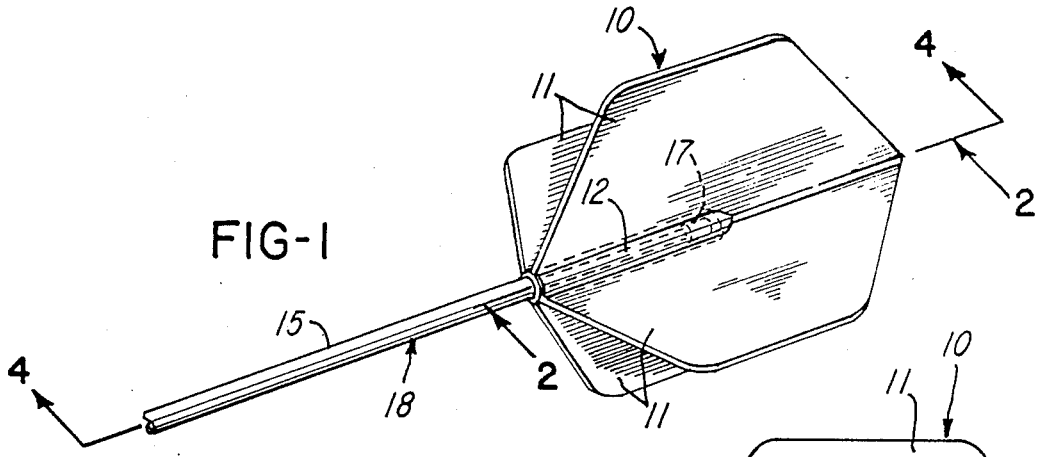
FIG. 1 is a fragmentary perspective view of a dart flight assembly of the dart flight of this invention shown mounted in place on its flight rotation shaft.
Figure 2:
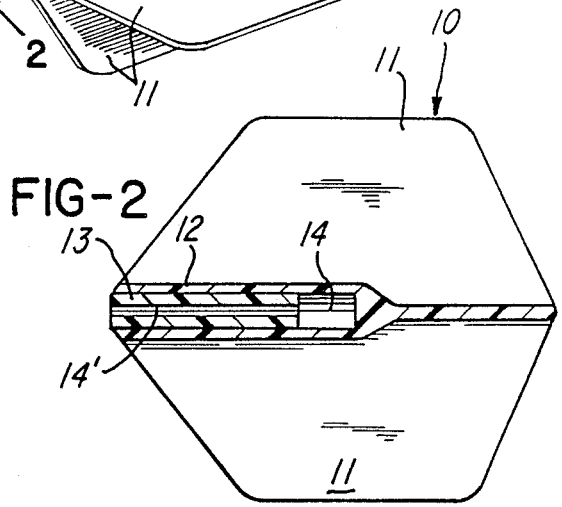
FIG. 2 is a cross-sectional view of the flight only of FIG. 1, and eliminating the flight shaft taken along lines 2—2 of FIG. 1, wherein the forward narrower flight cavity portion is produced by inserting a flight axial bore tube.
Figure 3:
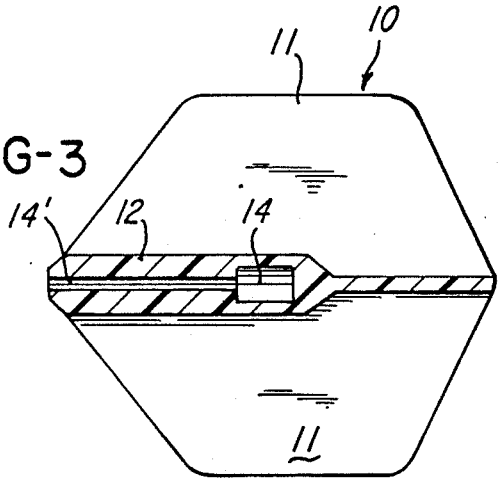
FIG. 3 is a modification of the flight shown in FIG. 2, but without a tube wherein the smaller (recess) and larger (extension) diameter flight axial cavity portion(s) are produced by molding around a mandrel or arbor, laminating or extruding said flight.

As illustrated in FIGS. 1 and 3, dart flight (10) contains flight fins or vanes (11) preferably, although not necessarily, integral with flight bushing tube (12), both preferably of plastic, providing a centrally located axis for insertion of the hub rear extension portion (17) and intermediate recess portion (16) of integral flight rotation shaft forward portion (18) within flight bushing tube (12) of the flight. As noted from FIGS. 2 and 4, recess portion (16) and extension portion (17) are also located within flight axial bore tube extension (13) in flights containing such tube (13). Within flight bushing tube (12), FIG. 3, and the structures additionally containing flight axial bore tube (13), FIGS. 2, 4 and 5, lies a central axial cavity having an extension front portion (14') communicating with a recess rear portion (14). See FIGS. 2 and 3. Recess rear cavity portion (14) accommodates extension (hub) portion (17) whereas extension front cavity portion (14') accommodates recess portion (16) of the mating portion of integral flight rotation shaft (18). While the flight cavity within flight bushing tube (12) is shown to extend approximately past mid flight, it should be understood that such cavity could extend the full length of flight (10).

Figure 4:
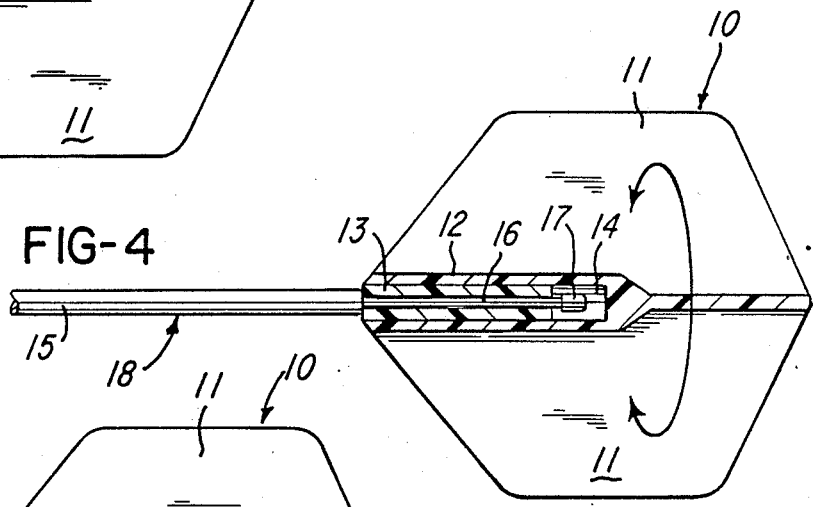
FIG. 4 is a fragmentary view with parts in section taken on line 4—4 of FIG. 1 and illustrates a dart flight rotation shaft assembly with the flight of this invention in position for rotation about a 360 degrees path, in either clockwise or counter-clockwise direction, on its flight rotation shaft.

As will be observed from FIG. 4, recess flight shaft intermediate portion (16) with integral extension (hub) portion (17) provides a mounting permitting the flight (10) to rotate freely within cavity portions (14') and (14). Since there is a gap or space between the inner surfaces of the flight cavity portions (14') and (14) and the outer surface of intermediate portion (16) and hub portion (17), respectively, of the flight shaft (18), the flight (10) is freely rotatable about its central axis 360 degrees in either direction, as shown by the arrow in FIG. 4. This has been referred to previously as slip-fit.

However, when the larger diameter forward portion (15) of the integral flight rotation shaft (18) is pushed so as to force a short length thereof into forward cavity portion (14') within the flight, there is friction between said forward portion (15) of the flight rotation shaft and the internal wall of either flight bushing tube (12), FIG. 3, or flight axial bore tube (13), which friction inhibits rotation of the flight (10).

While the internal axial cavity in the flights shown in FIGS. 2 through 5 is cylindrical in cross-section so as to accommodate cylindrical intermediate flight shaft recess portion (16) and extension portion (17); the flight cavity (14')–(14) could have any desired shape, viz., internal cross section, such as rectangular, square, triangular, etc., in the event rotatability of the flight was not an objective.

It will be observed that cavity portions (14')–(14) within flight bushing tube (12) provide the passageway through which recess portion (16) and extension portion (17) of flight rotation shaft (18) are pushed to insert them in the position permitting free 360 degree rotation, in either direction, of flight (10), or to place it in the non-rotatable position, at the election of the dart user.

Thus it will be observed that the present invention provides a dart flight (10) which can be mounted on the mating portion (16–17) of a flight rotation shaft (18) such that no portion of the flight rotation shaft means (17) of flight attachment to same is external to any external surface of said flight. Moreover, a dart flight has been provided having an internal cavity with an extension forward portion (14') communicating with a recess rear portion (14) lying within the central axis of the dart flight. The dimensions of recess rear cavity portion (14), extension front cavity portion (14'), flight shaft recess portion (16) and extension portion (17) are such that extension portion (17) can, with light pressure, be pressed through cavity portion (14') and into cavity portion (14) where it "snaps" in place. The flight is then free to rotate 360 degrees in either direction. Thus, the present invention provides a snap-on dart flight which can be installed readily on an integral flight rotation shaft and as readily removed therefrom and wherein the flight is either free to rotate 360 degrees in either direction about its central axis, or can be fixed in non-rotatable position, at the election of the user.

It is observed that the dart flight of this invention helps to reduce the possibility of a following dart striking the flight attachment means and producing a bounce-out. When the flight assembly of this invention is struck by a following dart, the likelihood that the path of said following dart will be deflected is reduced since the flight that is struck rotates out of the way and is no longer in the flight path of the following dart. It is further observed that the present invention provides a flight assembly that is readily attachable and detachable to the flight shaft by the simple procedure of inserting the shaft hub portion into the axial cavity of the flight.

Figure 5:
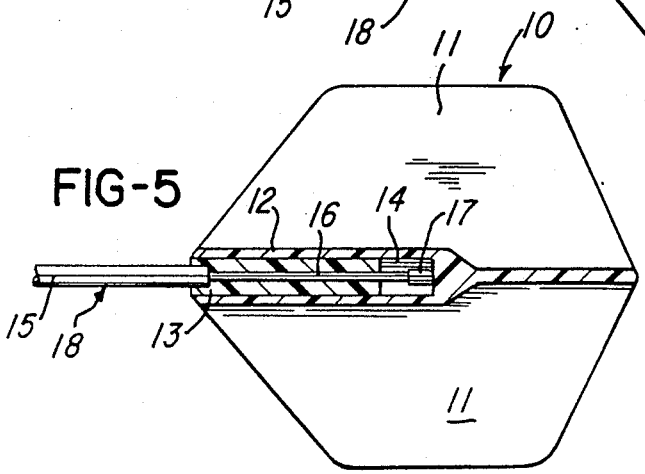
FIG. 5 is a view similar to that of FIG. 4, but illustrates a flight rotation shaft assembly with the flight of this invention in nonrotating position on its flight rotation shaft.
Figure 6:
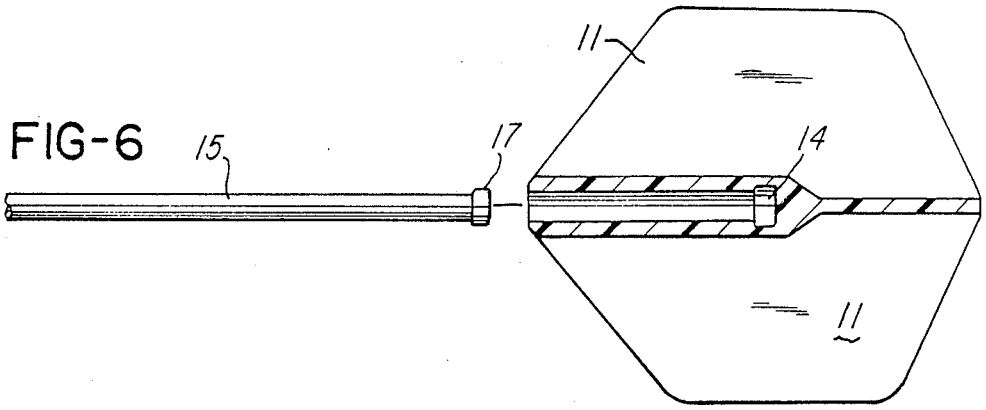
FIG. 6 is a fragmentary composite side and cross-sectional view of one embodiment of this invention illustrating a flight rotation shaft and flight prior to coupling (mating) having one substantially cylindrical extension (17) on the shaft with one recess (14) in the cavity of the corresponding flight.
Figure 7:
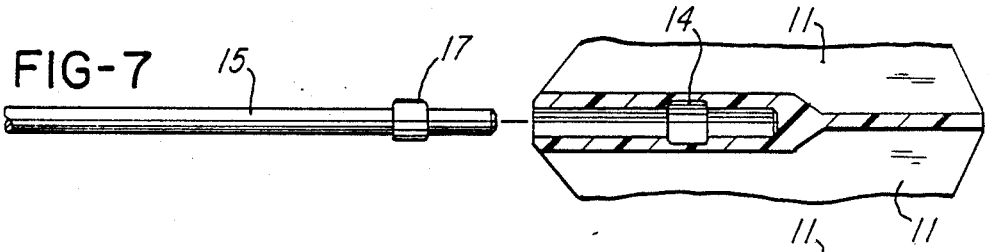
FIG. 7 is a fragmentary composite side and cross-sectional view of another embodiment of this invention similar to that of FIG. 6 but illustrating a single extension (17) on the flight rotation shaft which is wider than that shown in FIG. 6 with corresponding recess (14) on its flight.
Figure 8:
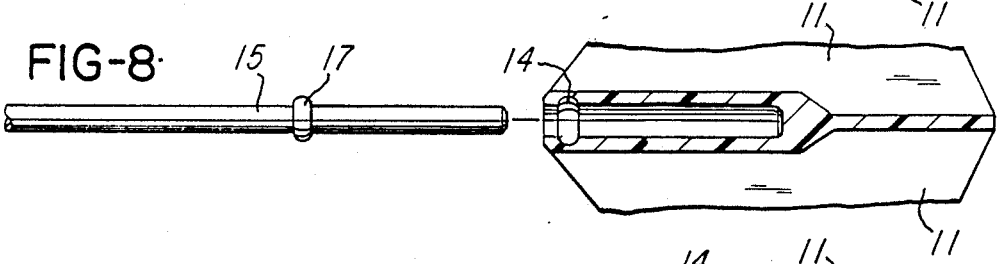
FIG. 8 is a view similar to those of FIGS. 6 and 7 but wherein the flight rotation shaft is provided with one or more substantially rounded extension(s) (17) with the flight cavity having a corresponding rounded recessed surface(s) (14). It will be observed that the number of recesses must be equal to or greater than the number of extensions.
Figure 9:
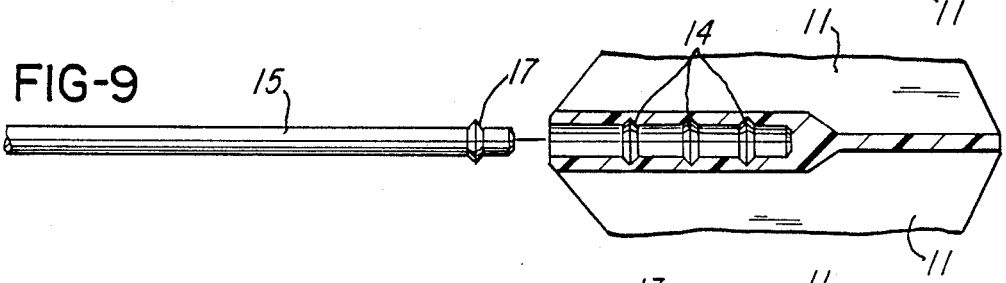
FIG. 9 is a view similar to those of FIGS. 6–8 but wherein the flight shaft extension or raised surface is substantially v-shaped in cross-section to accommodate one or more recesses of the flight cavity. This combination allows the shaft extension to mate in any one of three positions within the three recesses of the flight cavity and allows the length of the dart to be varied at will.
Figure 10:
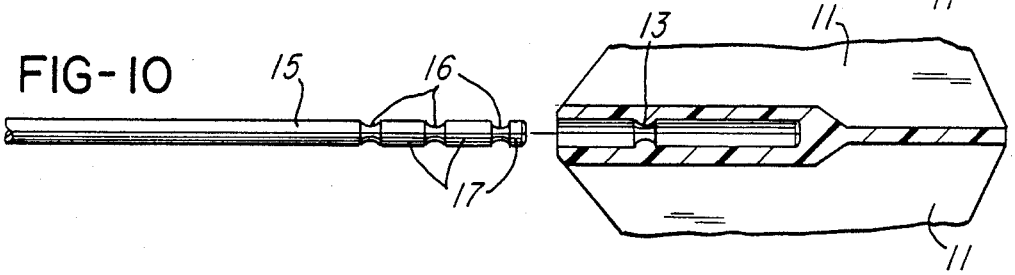
FIGS. 10 and 11 are views similar to FIGS. 6–9 but illustrate shaft-flight combinations wherein recesses (16) are provided in the flight rotation shaft and extensions (raised portions) (13) are provided in the flight cavity.
Figure 11:
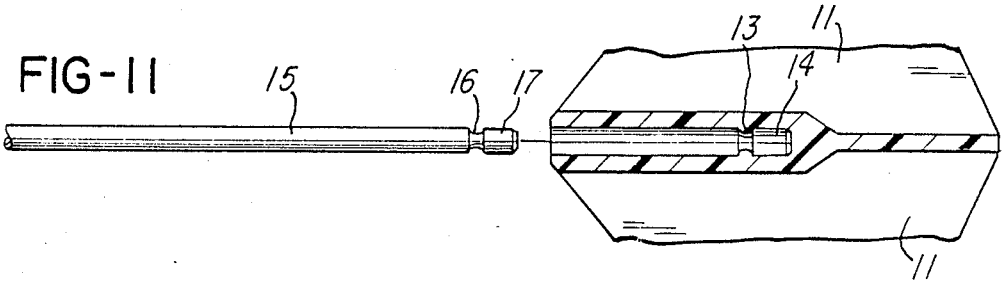

The flight rotation shaft illustrated in FIGS. 1, 4 and 5, is, per se, disclosed and claimed in my co-pending patent application Ser. No. 868,622 entitled "Dart Flight Rotation Shaft and Flight Rotation Shaft Assembly" filed on May 29, 1986. The entire disclosure of said patent application is incorporated herein by reference as if fully repeated herein. Ser. No. 868,622 also discloses and claims the flight rotation shaft assembly, viz., flight rotation shaft (18) in combination with flight (10).

In accordance with a preferred use of the flight of this invention, the present snap-on dart flight is employed as the flight on an anti-bounce-out dart in my co-pending patent application Ser. No. 868,621 filed on May 29, 1986 and entitled "Anti-Bounce-Out Dart", which claims said dart alone and in combination with the flight rotation shaft assembly of Ser. No. 868,622. The entire disclosure of said patent application Ser. No. 868,621 is incorporated herein by references as if fully repeated herein.

The dart flight of this invention is further characterized in that it eliminates prior art requirements for a flight attachment means external to the outer surfaces of said flight. The present dart flight eliminates the difficulties encountered in aligning multiple flight fins with transverse slots present in flight shafts of prior art darts in order to install said multiple flight fins therein. The dart flight of this invention virtually eliminates the probability present with prior art darts that the flight attachment means of a dart present in the target area of the dart hoard will either stop or deflect the subsequently thrown darts striking same so as to cause a bounce-out or fall-out, both of which result in zero points.

I claim:

1. A snap-on removably attached dart flight comprised of a flight bushing tube located along the central axis of said flight, a plurality of vanes or fins equally spaced around said flight bushing tube and an axial cavity whose inner diameter has one or more respective recess(es) and/or extension(s) whose distance(s) and shape conform substantially to those respective extension(s) and/or recess(es) mating portion(s) of a flight shaft and capable of engaging in a slip-fit union therewith yet leave a gap or a space therebetween permitting said flight to be free to rotate 360 degrees, clockwise or counter-clockwise, around such shaft and wherein said flight is characterized in that no portion of the means of flight attachment is external to any external surface of said flight.

2. A snap-on dart flight as in claim 1, wherein said axial cavity mating portion has one or more extension(s).

3. A snap-on dart flight as in claim 1 wherein said axial cavity mating portion has one or more recess(es).

4. A snap-on dart flight as in claims 1, 2 or 3 wherein said vanes or fins are integral with said flight bushing tube.

5. A snap-on dart flight as in claim 4 wherein said vanes or fins and said flight bushing tube are plastic.

6. A snap-on dart flight as in claim 4 including a flight axial bore tube whose inner surface defines said axial cavity mating portion.

7. A snap-on dart flight as in claim 4 wherein said flight axial bore tube is plastic.

* * * * *